US010479586B2

(12) United States Patent
Goldfarb

(10) Patent No.: US 10,479,586 B2
(45) Date of Patent: Nov. 19, 2019

(54) DISPENSING CONTAINER

(71) Applicant: Edward Goldfarb, Hollywood, FL (US)

(72) Inventor: Edward Goldfarb, Hollywood, FL (US)

( * ) Notice: Subject to any disclaimer, the term of this patent is extended or adjusted under 35 U.S.C. 154(b) by 0 days.

(21) Appl. No.: 16/173,170

(22) Filed: Oct. 29, 2018

(65) Prior Publication Data

US 2019/0062037 A1 Feb. 28, 2019

Related U.S. Application Data

(63) Continuation-in-part of application No. 15/586,504, filed on May 4, 2017, now abandoned.
(Continued)

(51) Int. Cl.
*B65D 83/00* (2006.01)
*B65D 1/02* (2006.01)
(Continued)

(52) U.S. Cl.
CPC ..... *B65D 83/00* (2013.01); *A45D 40/24* (2013.01); *B65D 1/023* (2013.01); *B65D 1/0207* (2013.01);
(Continued)

(58) Field of Classification Search
CPC ..... A47K 5/1214; A47K 5/122; A47K 5/13; A47K 5/18; A47K 5/1211; F16M 13/02; F16M 13/022; B65D 37/00; B65D 21/02; B65D 21/0204; B65D 21/0201; B65D 5/04; B65D 5/10; B65D 5/22; B65D 5/56; B65D 5/565; B65D 5/44; B65D 5/42; B65D 83/00; B65D 1/0207; B65D 1/023; B65D 1/24; B65D 25/22; B65D 25/42; B65D 41/04; B65D 2313/10; B65D 2501/0063; B65D 2501/0081; A45D 2040/0006; A45D 2040/0093
(Continued)

(56) References Cited

U.S. PATENT DOCUMENTS 3,955,715 A * 5/1976 Topor ..... A47K 5/12 222/143
4,470,523 A * 9/1984 Spector ..... A47K 5/122 156/314

(Continued)

*Primary Examiner* — Paul R Durand
*Assistant Examiner* — Andrew P Bainbridge
(74) *Attorney, Agent, or Firm* — Maier & Maier, PLLC

(57) ABSTRACT

A dispensing container configured to store at least one substance wherein the dispensing container is further configured to be releasably secured to a vertical support surface. The dispensing container includes a body being formed from a plurality of walls, a top and a bottom contiguously formed to create an interior volume. The interior volume is configured to have at least one storage compartment having a substance stored therein. The body further includes a first dispenser integrally formed on the front wall of the body proximate the bottom thereof. A second dispenser is further included and is formed in the bottom of the body. A mounting tab is secured to the rear wall of the body. The mounting tab includes an upper portion and a lower portion wherein the lower portion has a pressure sensitive adhesive disposed thereon. The body is manufactured from a lightweight material.

18 Claims, 9 Drawing Sheets

Related U.S. Application Data

(60) Provisional application No. 62/334,866, filed on May 11, 2016.

(51) Int. Cl.

| | |
|---|---|
| ***B65D 25/42*** | (2006.01) |
| ***B65D 1/24*** | (2006.01) |
| ***B65D 25/22*** | (2006.01) |
| ***B65D 41/04*** | (2006.01) |
| ***A45D 40/24*** | (2006.01) |
| *A45D 40/00* | (2006.01) |

(52) U.S. Cl.
CPC ..... *B65D 1/24* (2013.01); *B65D 25/22* (2013.01); *B65D 25/42* (2013.01); *B65D 41/04* (2013.01); *A45D 2040/0006* (2013.01); *A45D 2040/0093* (2013.01); *B65D 2313/10* (2013.01); *B65D 2501/0063* (2013.01); *B65D 2501/0081* (2013.01)

(58) Field of Classification Search
USPC ..... 222/135, 185.1, 181.1, 321.7–321.9, 222/383.1
See application file for complete search history.

(56) References Cited

U.S. PATENT DOCUMENTS 4,548,340 A 10/1985 Messer
4,657,176 A * 4/1987 Matsubara ..... B65D 31/08 220/908
4,793,517 A * 12/1988 Washut ..... A47K 5/1211 222/129
4,880,145 A 11/1989 McManus
4,969,587 A 11/1990 Miller
4,998,647 A 3/1991 Sharp
5,044,522 A 9/1991 Roig et al.
5,143,262 A 9/1992 Edlund
5,277,332 A * 1/1994 Rogers ..... A47K 5/12 221/96
5,311,992 A * 5/1994 Weder ..... B65D 5/50 206/423
5,409,144 A * 4/1995 Brown ..... B65D 47/2031 220/203.17
5,452,825 A 9/1995 Comstock et al.
5,507,464 A * 4/1996 Hamerski ..... A47G 1/175 248/205.3
5,516,581 A * 5/1996 Kreckel ..... A47G 1/175 428/317.3
5,649,643 A 7/1997 Ridgeway
5,887,762 A 3/1999 Hanna
5,954,213 A 9/1999 Gerhart et al.
5,984,247 A * 11/1999 Luhmann ..... A47G 1/175 248/205.3
6,004,642 A * 12/1999 Langford ..... C09J 7/20 428/40.1
6,041,971 A 3/2000 Pineda
6,162,534 A * 12/2000 Hamerski ..... C09J 7/22 428/354
6,179,166 B1 * 1/2001 Dallas, Jr. ..... A47K 5/1214 220/475
6,604,655 B1 8/2003 Lee
6,672,480 B1 1/2004 Miller
6,896,155 B1 5/2005 Jones et al.
7,178,693 B1 2/2007 Cutrone
7,261,221 B2 * 8/2007 Awbrey ..... B65D 23/003 222/181.3
7,874,466 B2 * 1/2011 McConville ..... B65D 47/2031 220/203.18
8,393,499 B1 3/2013 Sholem
8,973,878 B2 * 3/2015 Thompson ..... A47G 1/175 248/221.11
9,084,514 B1 7/2015 Elswick
9,668,618 B1 * 6/2017 Kassebaum ..... B05B 11/3001
10,221,883 B2 * 3/2019 Demsky ..... C09J 7/40
2001/0035430 A1 * 11/2001 Litscher ..... A45D 34/00 222/94
2007/0012727 A1 1/2007 Licari
2007/0102601 A1 * 5/2007 Thompson ..... A47G 1/175 248/205.1
2007/0108230 A1 5/2007 Doyle et al.
2008/0277149 A1 11/2008 Kuroda
2009/0294517 A1 * 12/2009 Zimmerman ..... B65D 5/4204 229/117.01
2015/0064386 A1 * 3/2015 Mag ..... B29C 65/50 428/41.8
2015/0190030 A1 7/2015 Podraza
2016/0236827 A1 * 8/2016 Adams ..... B65D 35/08
2016/0311602 A1 10/2016 Brace et al.
2017/0314608 A1 * 11/2017 Chang ..... A47G 1/16

* cited by examiner

DISPENSING CONTAINER

PRIORITY UNDER 35 U.S.C. Section 119(e) & 37 C.F.R. Section 1.78

This nonprovisional application claims priority based upon U.S. patent application Ser. No. 15/586,504, entitled Dispensing Container, and filed, May 4, 2017, which in turn claims priority to U.S. Provisional Patent Application No. 62/334,866, entitled Stick On Pull Off, and filed, May 11, 2016, both in the name of, Edward Goldfarb and which are hereby incorporated by reference for all purposes.

FIELD OF THE INVENTION

The present invention relates generally to dispensing apparatus, more specifically but not by way of limitation, a dispensing container having at least one storage compartment that is constructed of a lightweight eco-friendly material and is configured to be releasably secured to a wall such as but not limited to a shower wall in order to provide a product disposed hands-free to a user.

BACKGROUND

Everyday millions of people engage in routine hygiene practices that typically involve bathing. During the bathing process it is common for an individual to utilize various products and cleansers. By way of example but not limitation, some individuals will utilize a surfactant, shampoo and other products such as conditioner and lotion. All of these products are provided by the manufacturers thereof in various types of plastic bottles. The containers for the aforementioned products are configured with some means to assist in the dispensing of the product. It can be very common to utilize a shelf or a commonly known item, a shower caddy, to provide a means to organize and make available the containers and the products disposed therein to an individual in a shower. All current containers require physical handling, picking-up and/or pumping of the contents, and therefore it may be desired to have a hands-free dispenser.

One issue with conventional storage of hygiene product containers is the inability to store on a shelf or shower caddy and effectively have access to a specific container. Shelving and caddies typically become cluttered with the various containers and easy access thereto becomes cumbersome for a user in the shower.

Accordingly, there is a need for a dispensing container operable to store a product therein such as but not limited to shampoo, wherein the dispensing container is configured to be releasably secured to a shower wall so as to position the dispensing container in the open position and easily accessible in both location and usage.

SUMMARY

It is the object of the present invention to provide a dispensing container operable to store and dispense a fluid wherein the dispensing container has a body being configured to be releasably secured to a wall.

Another object of the present invention is to provide a dispensing container configured to assist in the ability to store and access a product disposed therein wherein the body of the dispensing container includes at least one storage compartment.

A further object of the present invention is to provide a dispensing container operable to store and dispense a fluid wherein the body further includes a mounting tab secured thereto.

An additional object of the present invention is to provide a dispensing container configured to assist in the ability to store and access a product disposed therein wherein the mounting tab is configured to releasably secure the dispensing container to a wall.

An alternative object of the present invention is to provide a dispensing container operable to store and dispense a fluid wherein the body is manufactured from a lightweight eco-friendly material.

Yet a further object of the present invention is to provide a dispensing container configured to assist in the ability to store and access a product disposed therein wherein the body includes a first dispenser and wherein the mounting tab is located on the body so as to position the first dispenser proximate the bottom of the body.

An additional object of the present invention is to provide a dispensing container operable to store and dispense a fluid wherein the body includes a second dispenser and wherein the second dispenser is proximate the bottom of the body.

Still another object of the present invention is to provide a dispensing container configured to assist in the ability to store and access a product without the need to physically handle the product disposed therein wherein the body is positioned on a wall such that the dispensing of the product is assisted via gravitational forces.

Yet a further object of the present invention is to provide a dispensing container operable to store and dispense a fluid wherein the mounting tab further includes an easy release pull.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE FIGURES

A more complete understanding of the present invention may be had by reference to the following Detailed Description and appended claims when taken in conjunction with the accompanying Drawings wherein:

DETAILED DESCRIPTION

Figure 1:
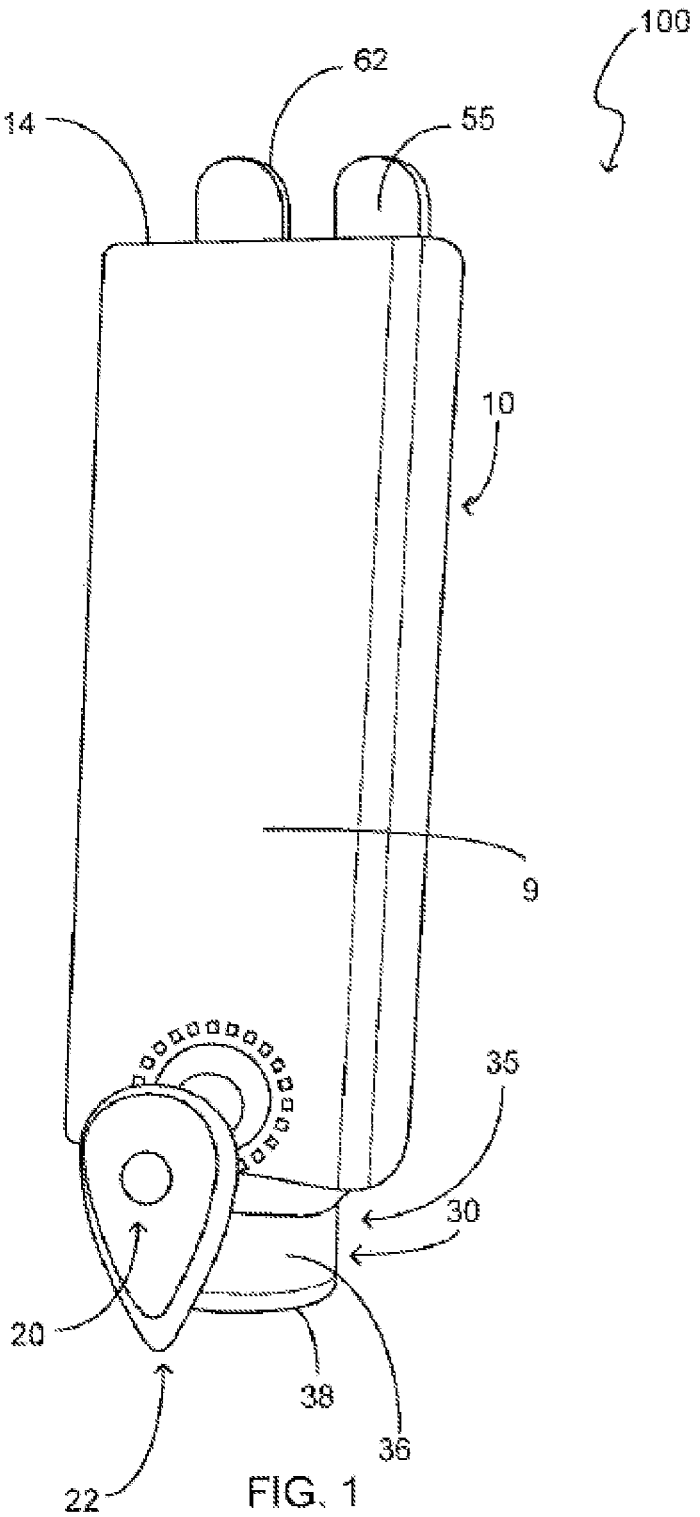
FIG. 1 is a perspective view of an embodiment of a dispensing container.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Referring now to the drawings submitted herewith, wherein various elements depicted therein are not necessarily drawn to scale and wherein through the views and figures like elements are referenced with identification reference numerals, there is diagrammed a dispensing container 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Figure 2:
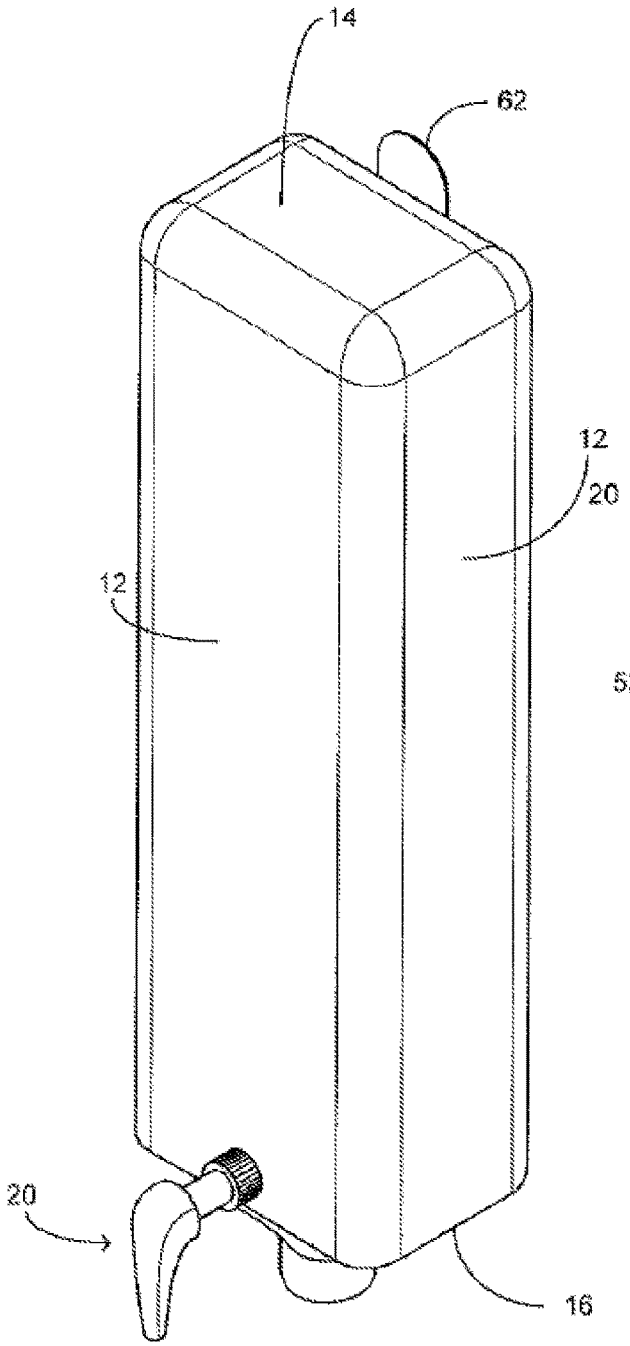
FIG. 2 is a perspective view of an embodiment of a dispensing container.

Referring now to FIG. 1 and FIG. 2 herein, the dispensing container 100 includes body 10. Body 10 is manufactured from a lightweight waterproof material such as but not limited to plastic, paperboard with thin layers of aluminum and polyethylene, or plasticized cardboard. Within the scope of the present invention as will be further discussed herein it is desired that the body 10 be lightweight. The lightweight characteristic of the body 10 assists in the maintenance of the position of the dispensing container 100 subsequent to being mounted to a vertical support structure such as but not limited to a shower wall. The body 10 includes a plurality of walls 12, a top 14 and a bottom 16 contiguously formed to create an interior volume wherein the interior volume is configured to receive and store a fluid material such as but not limited to a surfactant or a lotion. While the exemplary body 10 illustrated herein is elongated and rectangular in shape having chamfered corner edges, it is contemplated within the scope of the present invention that the body 10 could be formed in numerous alternate shapes and sizes and still achieve the desired functionality as described herein.

Integrally connected with the body 10 on the front wall 9 proximate bottom 16 is first dispenser 20. As is illustrated in the drawings herein, the dispensing container 100 is mounted to a suitable vertical support surface. This mounting allows utilization of gravitational forces to assist in the egression of a substance disposed within the interior volume of the body 10. The first dispenser 20 is a conventional pump style dispenser that is moved in an oscillating manner in order to transfer a substance disposed within the interior volume of the body 10 out of nozzle 22 to be utilized by a user. The first dispenser 20 utilizes gravity and a passage (not particularly illustrated herein) to supply the substance disposed within the interior volume of the body 10 to the first dispenser 20 so as to be discharged therefrom. While a pump style dispenser has been disclosed herein as a preferred embodiment for the first dispenser 20, it is contemplated within the scope of the present invention that the first dispenser 20 could be configured as an aerosol dispenser or other conventional dispenser known in the art suitable for facilitating the discharge of a product disposed within the interior volume of the body 10.

The dispensing container 100 further includes a second dispenser 30. Second dispenser 30 is mounted to bottom 16 and is operable to assist in the discharge of a substance disposed within the body 10 that is unable to be discharged by the first dispenser 30. The second dispenser 30 includes a cap 35 having a first portion 36 and a second portion 38. First portion 36 is secured to bottom 16 utilizing suitable techniques such as but not limited to threads. Second portion 38 is hingedly attached to the first portion 36 so as to allow the substance disposed within the interior volume of the body 10 to egress from an opening (not illustrated herein) formed in the first portion 36. While a preferred embodiment of the second dispenser 30 has been disclosed herein, it is contemplated within the scope of the present invention that the second dispenser 30 could be configured in alternate manners and still achieve the desired objective as described herein. The utilization of the first dispenser 20 and second dispenser 30 allows a user to select either to discharge a substance from the interior volume of the body 10. Further, integrating the first dispenser 20 and the second dispenser 30 each having the positions described herein facilitates the ability for the substantial removal of all of the material disposed within the interior volume of the body 10. While a first dispenser 20 and a second dispenser 30 have been disclosed herein, it is contemplated within the scope of the present invention that the body 10 could have integrated thereinto only one dispenser configured as either the first dispenser 20 or second dispenser 30.

Figure 3:
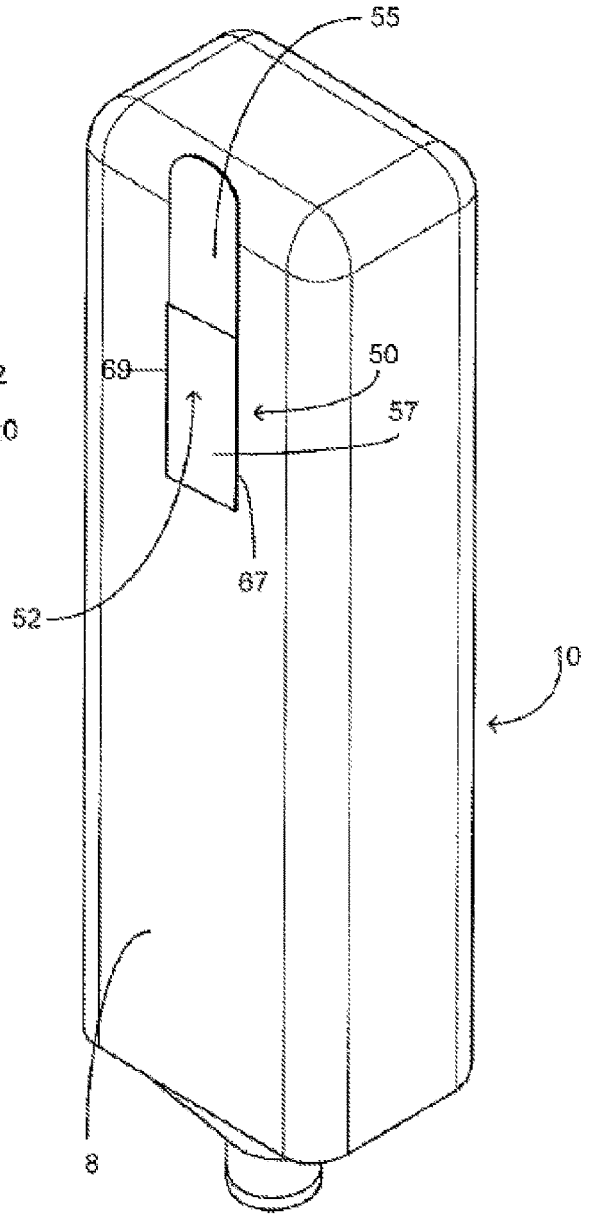
FIG. 3 is a perspective view of an embodiment of a dispensing container.

Referring now to FIG. 3, the mounting tab 50 of the dispensing container 100 is illustrated therein. The mounting tab 50 is manufactured from a suitable material such as but not limited to synthetic rubber. The mounting tab 50 is secured to the rear wall 8 of the body 10 utilizing suitable durable techniques such as but not limited to chemical adhesion. The mounting tab 50 includes a first side (adjacent to the rear wall 8) and a second side 52. The mounting tab 50 includes upper portion 55 and lower portion 57 integrally formed to create a single body for the mounting tab 50. The lower portion 57 of the mounting tab 50 has a pressure sensitive adhesive disposed thereon on the second side 52. The pressure sensitive adhesive is operable to secure the body 10 to a suitable vertical support structure such as but not limited to a shower wall. It is contemplated within the scope of the present invention that various types of pressure sensitive adhesives could be utilized to achieve the aforementioned functionality. More specifically but not by way of limitation, the pressure sensitive adhesives could be acrylic polymer adhesives or block copolymers. It is further contemplated within the scope of the present invention that more than one mounting tab 50 could be secured to the body 10 so as to secure a larger embodiment of the dispenser container 100. By way of example but not limitation, the body 10 could have two or three mounting tabs 50 secured thereto.

Contiguously formed with the lower portion of the mounting tab 50 is upper portion 55. The upper portion 55 functions as a release pull so as to facilitate the removal of the mounting tab 50 from the support surface to which it has been adhered. The upper edge 62 of the upper portion 55 provides an interface in conjunction with the upper portion 55 for a user to grasp and execute removal of the mounting tab 50. The upper portion 55 exposed above the top 14 is grasped by a user and pulled in an upwards direction. As the upper portion 55 is pulled in an upwards direction the mounting tab 50 being manufactured from a synthetic rubber begins to elongate and as such the opposing lateral edges 67, 69 of the lower portion 52 begin to move more proximate each other and reduce the adhesion between the mounting tab 50 and the surface to which it is adhered. As the upper portion 55 is continually pulled upwards the lower portion is released from the surface to which it is adhered.

Figure 4:
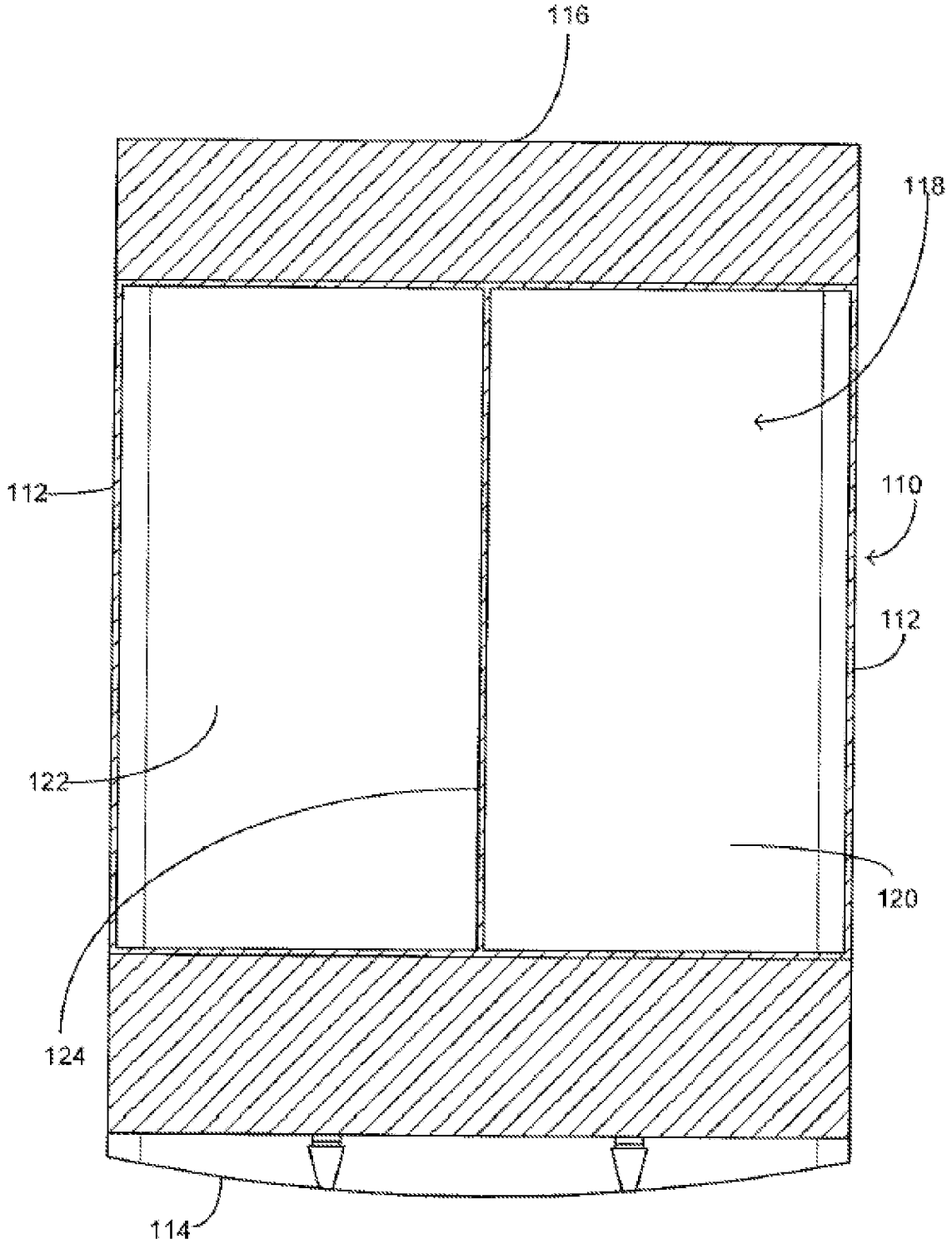
FIG. 4 is a cross-sectional view of a body of a dispensing container.

Referring to FIG. 4 herein, an alternative embodiment of the body 10 is illustrated therein. The body 110 includes walls 112, bottom 114 and top 116 integrally formed to create an interior volume 118. The interior volume 118 is divided into a first compartment 120 and a second compartment 122 utilizing divider 124. While one divider 124 is illustrated herein, it is contemplated within the scope of the present invention that the body 110 could have more than one divider so as to form a plurality of storage compartments. The body 110 functions identically as body 10 previously discussed herein and is illustrated herein to demonstrate a desired alternative embodiment of the body 10 wherein the interior volume 118 can include a first compartment 120 and a second compartment 120 so as to provide storage and dispensing of more than one product. By way of example but not limitation, the first compartment 118 and the second compartment 122 could be utilized to store and dispense shampoo and conditioner. All other features and elements of the body 110 are identical to the body 10 as previously discussed herein.

Figure 5:
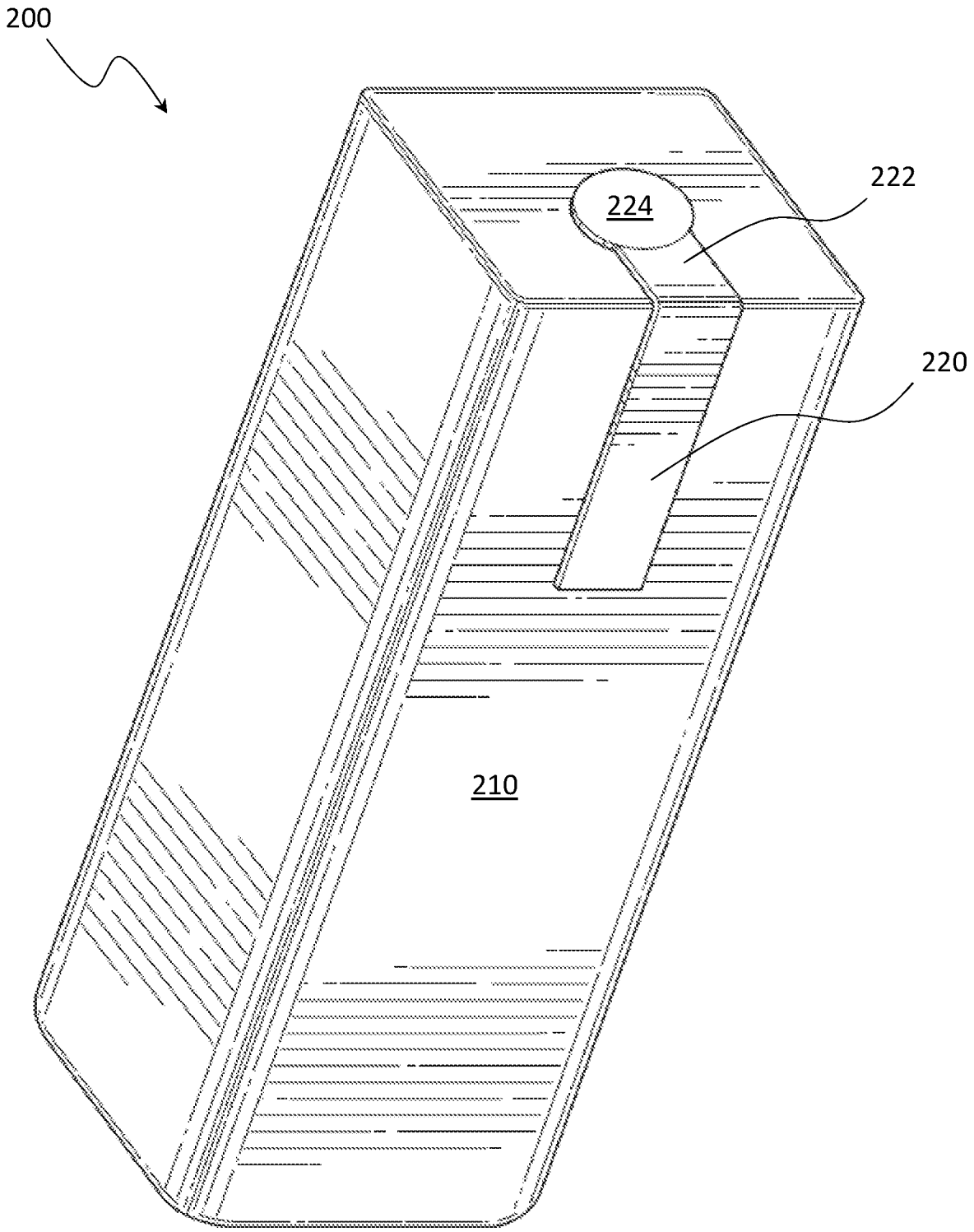
FIG. 5 shows a top perspective view of an embodiment of a two-compartment dispensing container.

Now referring to exemplary FIG. 5, a dispensing container 200 may be provided. Dispensing container 200 may include a body 210, which may have at least one mounting tab 220. According to an exemplary embodiment, mounting tab 220 may be an adhesive strip or tab as described above. Mounting tab 220 may be permanently affixed to body 210, may be integrally formed with body 210, or may be removably affixed to body 210. In some embodiments, mounting tab 220 may be a double-sided adhesive strip and each side may have the same or different degrees of adhesive properties. In some embodiments, the side affixed to body 210 may have a stronger adhesive, which in some cases may be semi-permanent. Mounting tab 220 may maintain adhesive qualities in a wet environment. Mounting tab 220 may be capable of adhering to various surfaces including tile, mirror, drywall, wood or plastic. Mounting tab 220 may further include an upper portion 222, which may be used to facilitate removal of the mounting tab 220 from a surface on which container 200 is mounted. Upper portion 222 may not have adhesive surfaces and may be folded onto a top surface of container 200 when not in use. Upper portion 222 may be held in a folded state by a sticker or tape 224. In some embodiments, mounting tab 220 may have a surface area smaller than the rear surface of the body 210, on which the mounting tab 220 may be provided. Furthermore, the mounting tab 220 may allow the container 200 to be mounted to a wall or surface without an intermediate mounting surface, base sheet, or other mounting hardware.

Figure 6A:
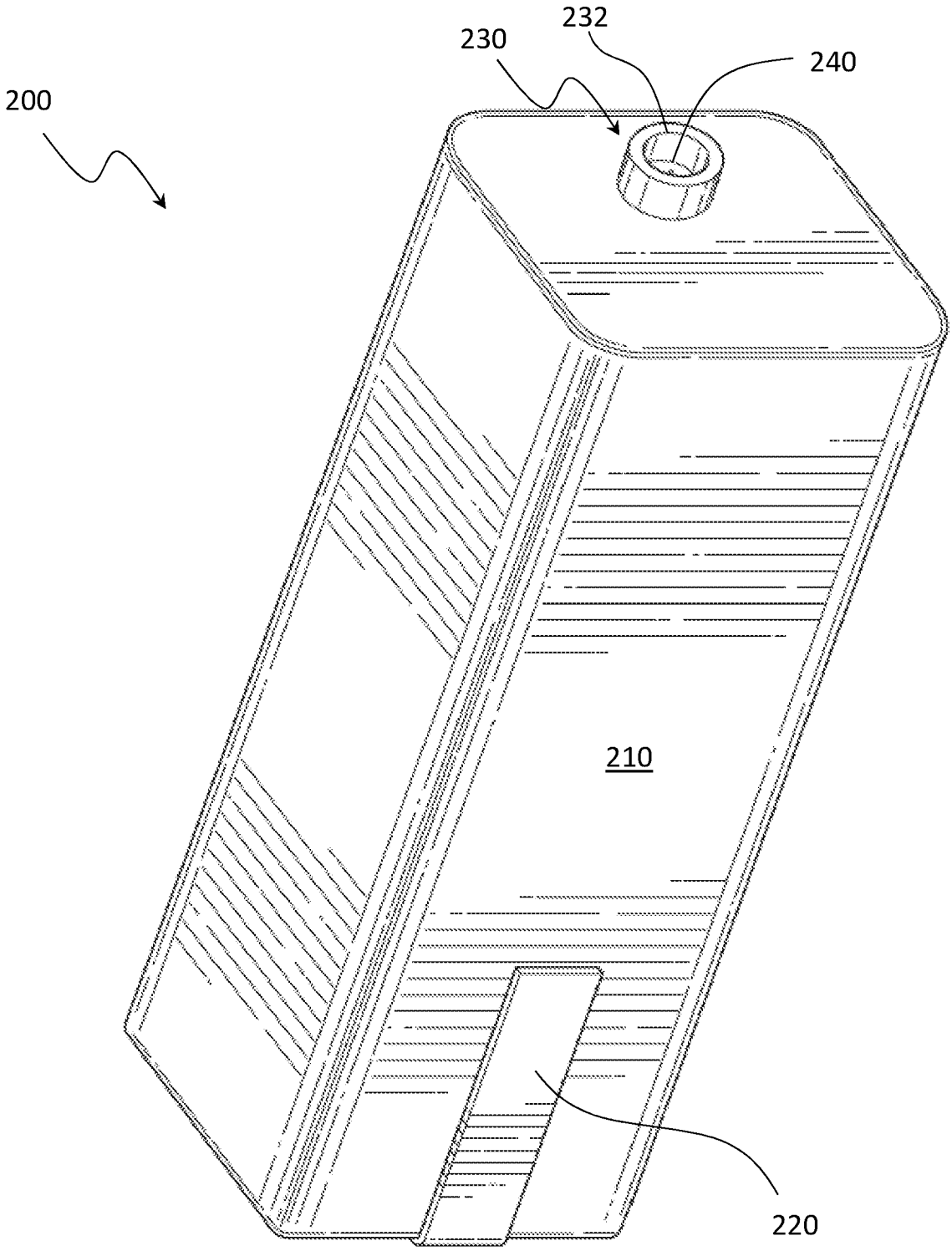
FIG. 6A shows a bottom perspective view of an embodiment of a dispensing container.
Figure 6B:
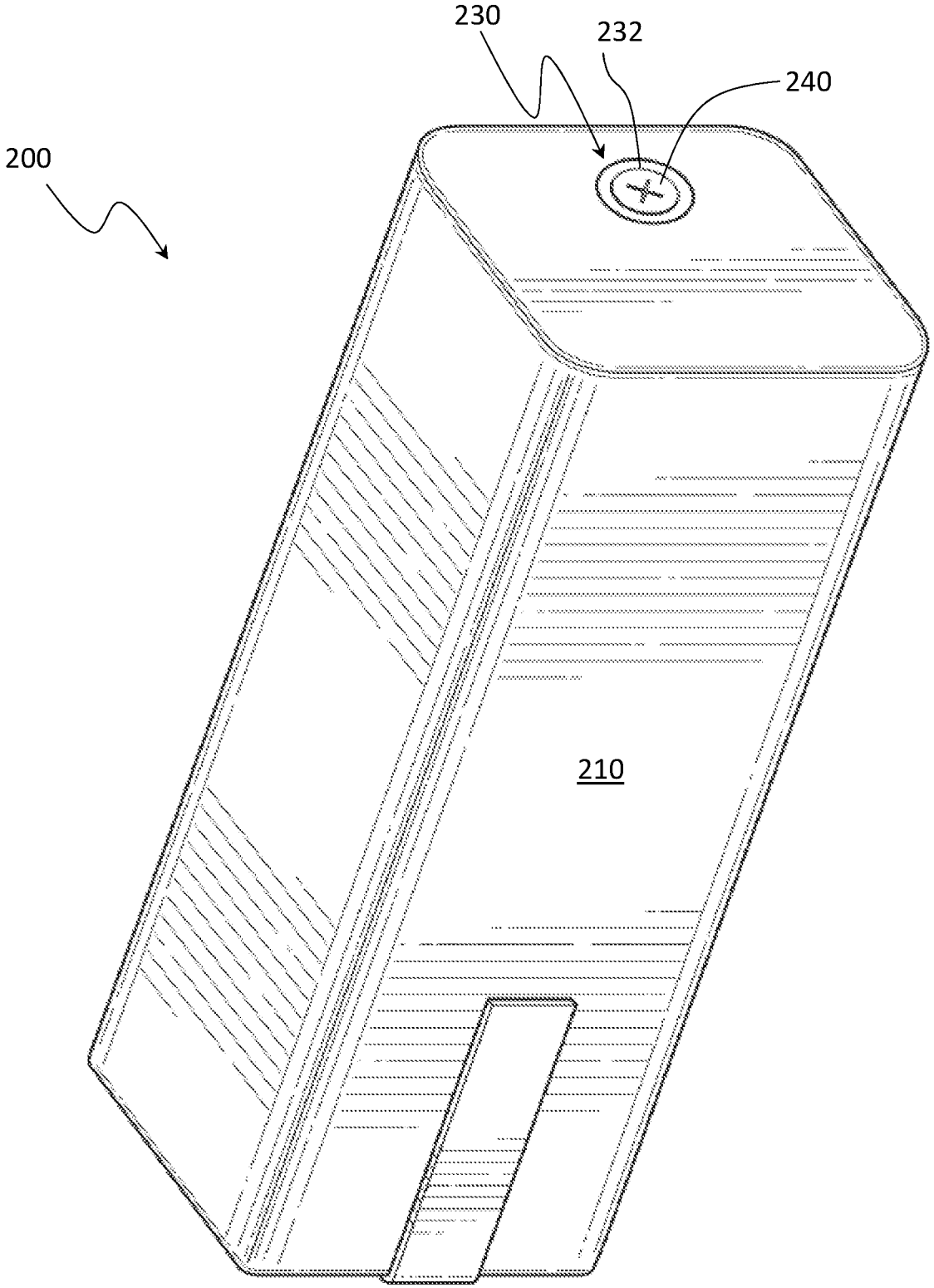
FIG. 6B shows a top perspective view of an embodiment of a dispensing container.
Figure 7:
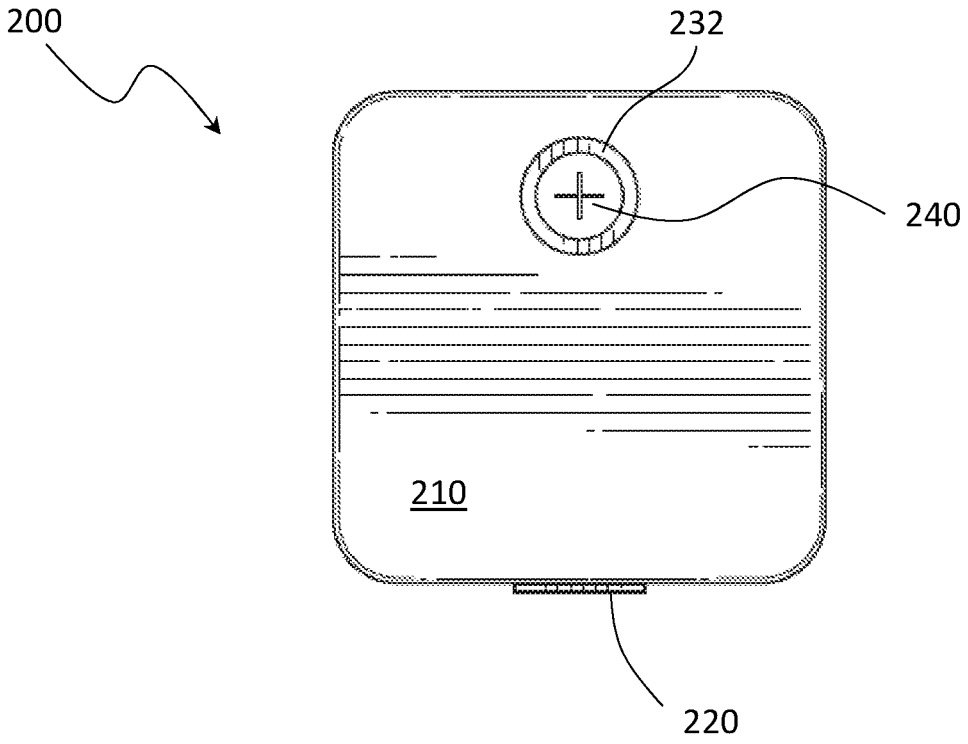
FIG. 7 shows a bottom plan view of an embodiment of a dispensing container.

As shown in exemplary FIG. 6A-7, dispensing container 200 may further include a spout 230, through which contents of the container may be dispensed. Spout 230 may be formed through a bottom surface of container 200, such that gravity forces the contents toward spout 230. The container may optionally include a neck portion, which may be angled from approximately the side walls toward spout 230. Spout 230 a resilient, self-sealing portion or valve 240 such that when a product or liquid is dispensed through spout 230, the material may flex to provide an opening or otherwise become porous, while self-sealing portion 240 may return to a sealed state after dispensing. In some embodiments, spout 230 may further include a rigid perimeter or frame 232, which may be a tube. Dispensing may occur by applying pressure to body 210, such that the pressure forces contents through spout 230. In other words, spout 230 may be pressure-activated. According to an exemplary embodiment, self-sealing portion 240 may be silicone and may have at least one slit disposed therethrough. Self-sealing portion 240 may, in some embodiments, be a one-way valve. The spout 230 may optionally include a cap or may not include a cap. In some further embodiments, the spout 230 may be offset from the bottom surface of the body 210 by way of the spout's rigid perimeter or frame 232, while in other embodiments, the spout 230 may be flush with the bottom surface of body 210, as shown in FIG. 6B.

Figure 8:
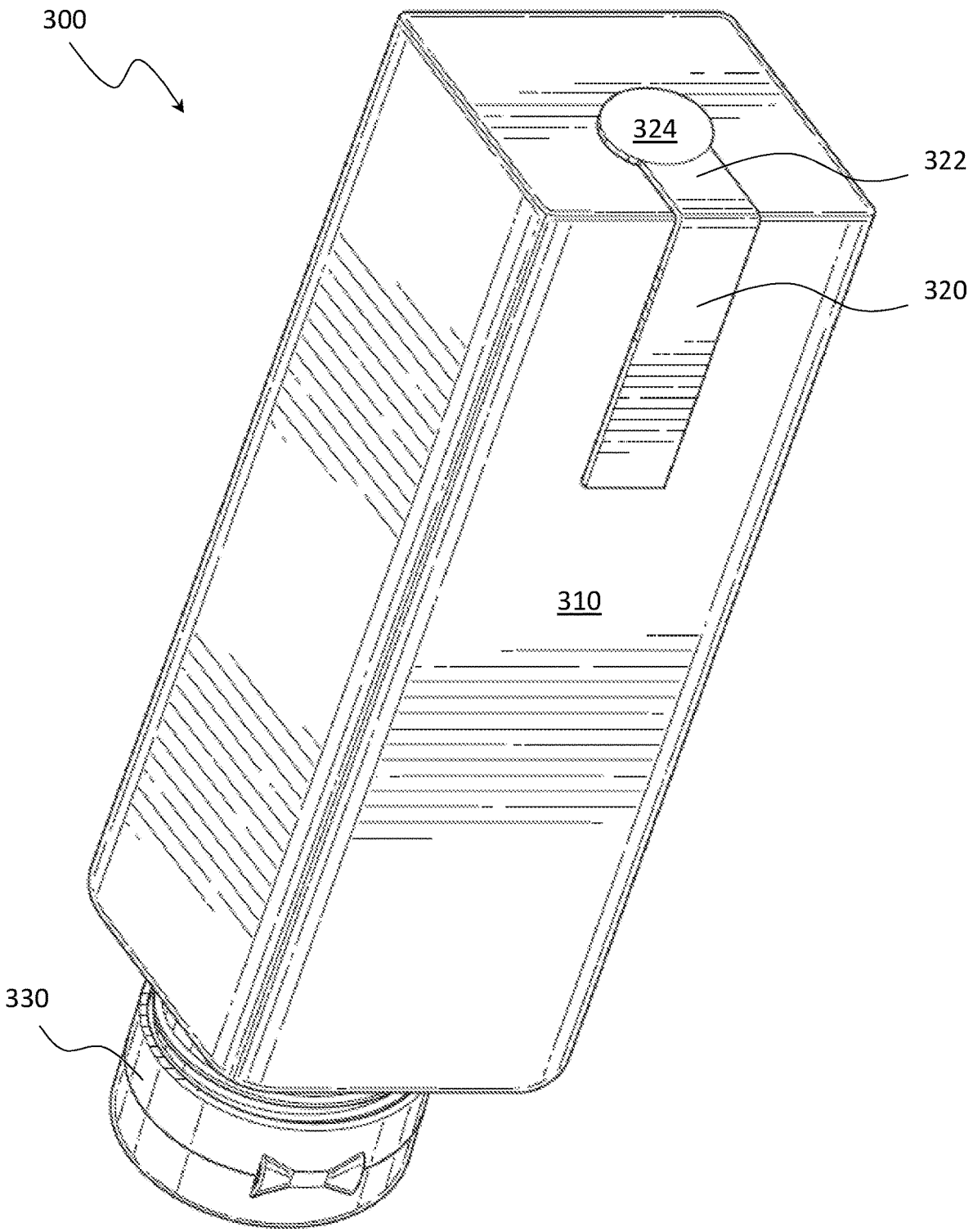
FIG. 8 shows a top perspective view of an embodiment of a dispensing container.
Figure 9:
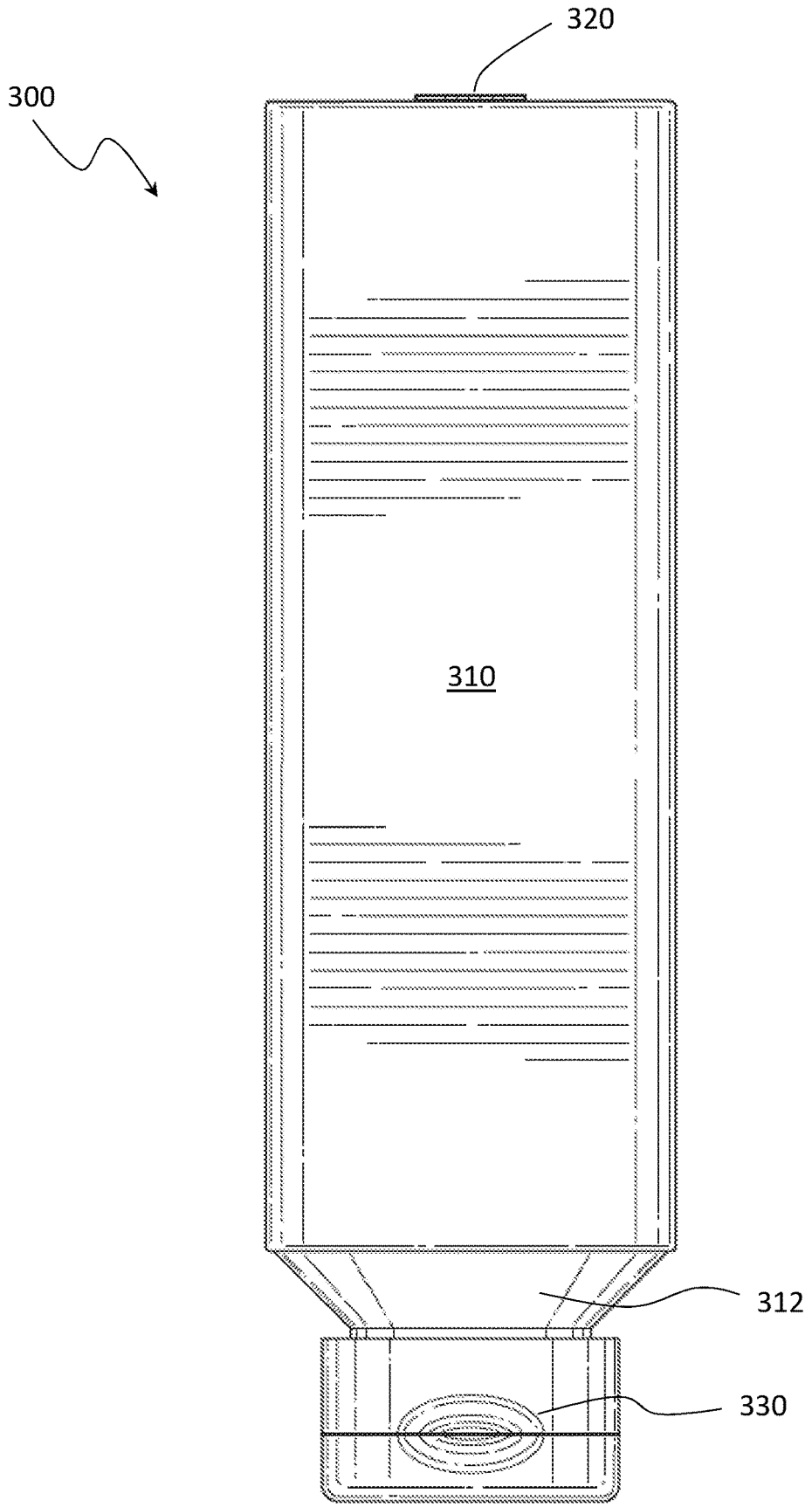
FIG. 9 shows a front view of an embodiment of a dispensing container.

Now referring to exemplary FIGS. 8-9, an exemplary dispensing container 300 may be provided. Container 300 may include a body 310 and a mounting surface or tab 320. Surface tab may include an upper portion 322 and sticker 324, as described above. Furthermore, container body 310 may include a cap 330 disposed through a bottom surface of container 300. Cap 330 may be a screw-on cap, which may have a spout disposed therethrough. The spout may optionally be a hole, which may be sealed by closing cap 330, or may include a silicone valve. Cap 330 may be a hinged or flip cap. In some embodiments, container body 310 may include a neck 312 on its bottom. Cap 330 may be affixed to neck 312. Neck 312 may be angled to facilitate gravitational flow of any contents toward cap 330, which may be a dispensing cap. Neck 312 may be angled from approximately the side walls to the cap.

The container body may be made of paperboard, plastic, paper, cardboard, rubber, or other materials as would be understood by a person having ordinary skill in the art. In at least one embodiment, the container body may be a substantially rectangular cuboid. The container may further include a coating and/or liner which may be water resistant or otherwise capable of retaining liquids. In some embodiments, contents may be held in a bag within the container. The container body may be deformable, such that a user can squeeze the container body to dispense the contents and the body may be resilient, such that it returns to a desired resting shape. The cap and/or spout being disposed on a bottom surface of the container may allow the contents to be dispensed using only the force of gravity or optionally by way of gravity and pressure applied to the container body. Furthermore, the mounting surface may be an adhesive strip which may optionally be a one-time use adhesive strip or a multi-use strip. Each of the embodiments disclosed herein may be utilized in a single dispenser, dual-dispenser, or other multi-dispenser arrangements. The elements described with regard to each embodiment may be utilized with other embodiments described herein, as would be understood by a person having ordinary skill in the art.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A dispensing container comprising:

a body having a plurality of walls and a top and a bottom surface contiguously formed to create an interior volume;

a mounting tab disposed partially on a rear surface of the body, wherein the mounting tab comprises an adhesive strip having a front portion and a rear portion, the front portion having a first adhesive portion with a first adhesive located on one of the plurality of walls, a second portion devoid of adhesive that is configured to be folded over the top of the body, and an upper portion with a second adhesive disposed on the top of body, wherein the second adhesive has weaker adhesion than the first adhesive; and a spout disposed through the bottom surface of the body, wherein the spout comprises a silicone valve.

2. The dispensing container of claim 1, further comprising a neck portion angled from the side walls to the spout.

3. The dispensing container of claim 1, wherein the mounting tab is configured to releasably secure the body to a vertical support surface.

4. The dispensing container of claim 1, wherein the mounting tab has a smaller surface area than the rear surface of the body.

5. The dispensing container of claim 1, wherein the container does not include a cap.

6. The dispensing container of claim 1, wherein the body is substantially a rectangular cuboid.

7. The dispensing container of claim 1, wherein the container has no base sheet or intermediate mounting surface.

8. The dispensing container of claim 1, wherein the body is made of paperboard.

9. The dispensing container of claim 1, further comprising a hinged cap.

10. The dispensing container of claim 9, wherein the hinged cap is removably threaded onto a neck portion of the body.

11. The dispensing container of claim 1, further comprising two mounting tabs.

12. The dispensing container of claim 1, wherein the upper portion of the mounting tab extends above the top surface of the body, and wherein the upper portion is configured to be moved in an upward direction.

13. The dispensing container of claim 12, wherein the mounting tab is manufactured from synthetic rubber and a pressure sensitive adhesive is disposed on a lower portion of the mounting tab.

14. The dispensing container of claim 13, wherein the lower portion of the mounting tab has opposing lateral edges configured to become more proximate each other during an upward movement of the upper portion.

15. The dispensing container of claim 1, wherein the spout is gravity fed.

16. The dispensing container of claim 1, wherein the spout is pressure activated.

17. The dispensing container of claim 1, wherein the body comprises at least two storage compartments and at least one spout being fluidly coupled to a bottom surface of each of the at least two storage compartments.

18. The dispensing container of claim 1, further comprising a pump, the pump positioned orthogonally from the spout and projecting outwards from the body.

* * * * *